US006516890B1

(12) United States Patent
Jackson et al.

(10) Patent No.: US 6,516,890 B1
(45) Date of Patent: Feb. 11, 2003

(54) APPARATUS AND METHOD FOR PREVENTING THE INADVERTENT ACTIVATION OF THE ACTUATING MECHANISM OF A WELL TOOL

(75) Inventors: Stephen L. Jackson, Richmond, TX (US); John R. Whitsitt, Houston, TX (US); David R. Mandeville, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/689,417

(22) Filed: Oct. 12, 2000

Related U.S. Application Data

(60) Provisional application No. 60/162,379, filed on Oct. 29, 1999.

(51) Int. Cl.[7] ..... E21B 23/00

(52) U.S. Cl. ..... 166/381; 166/181; 166/237; 166/332.4

(58) Field of Search ..... 166/381, 387, 166/123, 125, 181, 182, 332.1, 332.4, 237, 240

(56) References Cited

U.S. PATENT DOCUMENTS

| | | | | |
|---|---|---|---|---|
| 5,413,173 A | * | 5/1995 | Mills et al. | 166/212 |
| 5,884,699 A | * | 3/1999 | Mullen et al. | 166/134 |
| 6,349,772 B2 | * | 2/2002 | Mullen et al. | 166/387 |
| 6,382,324 B1 | * | 5/2002 | Anyan | 166/382 |

* cited by examiner

*Primary Examiner*—David Bagnell
*Assistant Examiner*—Zakiya Walker
(74) *Attorney, Agent, or Firm*—Trop, Pruner & Hu, P.C.; Jeffrey E. Griffin; Brigitte L. Jeffery

(57) ABSTRACT

A protective member that is disposed within the longitudinal bore of a well tool, the well tool including an actuating mechanism adapted to be mechanically activated from the longitudinal bore. The actuating mechanism includes an engagement section, preferably a profile. The protective member, preferably a sleeve, substantially covers the actuating mechanism while leaving the engagement section exposed to the longitudinal bore. In a preferred embodiment, the sleeve is slidably disposed within the longitudinal bore between a first position and a second position. A biasing mechanism biases the sleeve into the first position, in which a sleeve first end is proximate the profile. Operation of the apparatus enables a method for preventing the inadvertent mechanical activation of the actuating mechanism of a well tool as peripheral equipment is passed through the longitudinal bore of the well tool.

30 Claims, 5 Drawing Sheets

APPARATUS AND METHOD FOR PREVENTING THE INADVERTENT ACTIVATION OF THE ACTUATING MECHANISM OF A WELL TOOL

This application claims the benefit under 35 USC 119(e) of U.S. Provisional Application No. 60/162,379 filed by Jackson, Whitsitt, and Mandeville on Oct. 29, 1999.

BACKGROUND OF THE INVENTION

1. Field of Invention

The present invention generally relates to the field of downhole tools. More specifically, the invention relates to an apparatus and method for preventing the inadvertent mechanical activation of the actuating mechanism of a well tool as equipment is being passed through the longitudinal bore of the well tool.

2. Related Art

Many well tools include actuating mechanisms that are mechanically activated by an activating tool disposed in the longitudinal bore of the well tool. Typically, the actuating mechanism includes an engagement section, which normally comprises a profile, that is exposed to the longitudinal bore of the well tool and that corresponds to a latch or key on the activating tool. Thus, when the activating tool is run through the longitudinal bore of the well tool, the latch or key finds and locks on the engagement section or profile and further movement of the activating tool forces the actuating mechanism to also move thereby activating it.

At various times during the downhole life of such well tools, however, pieces of equipment are run downhole and are passed through the longitudinal bore of the well tool. Illustrative of such types of equipment are coil tubing, wireline, and slick line. Illustrative of such pieces of equipment are logging tools, testing tools, shifting collets, and locators. As such equipment passes through the longitudinal bore, the equipment may drag on the actuating mechanism or catch on the engagement section or profile. The drag force or catch force exerted by the equipment on the actuating mechanism and/or profile sometimes inadvertently causes the movement and activation of the actuating mechanism. Inadvertent activation of a well tool is of course unwanted and may result in a substantial loss of time, money, and resources. The prior art would therefore benefit from an apparatus and method that prevents the inadvertent mechanical activation of the actuating mechanism of a well tool as peripheral equipment is passed through the longitudinal bore of the well tool. It would be a further benefit to the prior art if such apparatus and method allows the normal and desired activation of the actuating mechanism by way of the corresponding activating tool. In addition, the prior art would benefit if such apparatus and method is simple and easy to manufacture and install on new and existing well tools.

SUMMARY OF THE INVENTION

It is therefore an objective of the present invention to provide an apparatus and method that:

- prevents the inadvertent mechanical activation of the actuating mechanism of a well tool as peripheral equipment is passed through the longitudinal bore of the well tool;
- allows the normal and desired activation of the actuating mechanism by way of the corresponding activating tool; and
- is simple and easy to manufacture and install on new and existing well tools.

Other objectives of the present invention will be obvious by reading the specification and claims appended hereto.

To achieve such objectives, my invention is a protective member that is disposed within the longitudinal bore of a well tool, the well tool including an actuating mechanism adapted to be mechanically activated from the longitudinal bore. The actuating mechanism includes an engagement section, preferably a profile. The protective member, preferably a sleeve, substantially covers the actuating mechanism while leaving the engagement section exposed to the longitudinal bore. In a preferred embodiment, the sleeve is slidably disposed within the longitudinal bore between a first position and a second position. A biasing mechanism biases the sleeve into the first position, in which a sleeve first end is proximate the profile. Operation of the apparatus enables a method for preventing the inadvertent mechanical activation of the actuating mechanism of a well tool as peripheral equipment is passed through the longitudinal bore of the well tool.

DETAILED DESCRIPTION OF THE INVENTION

Figure 1:
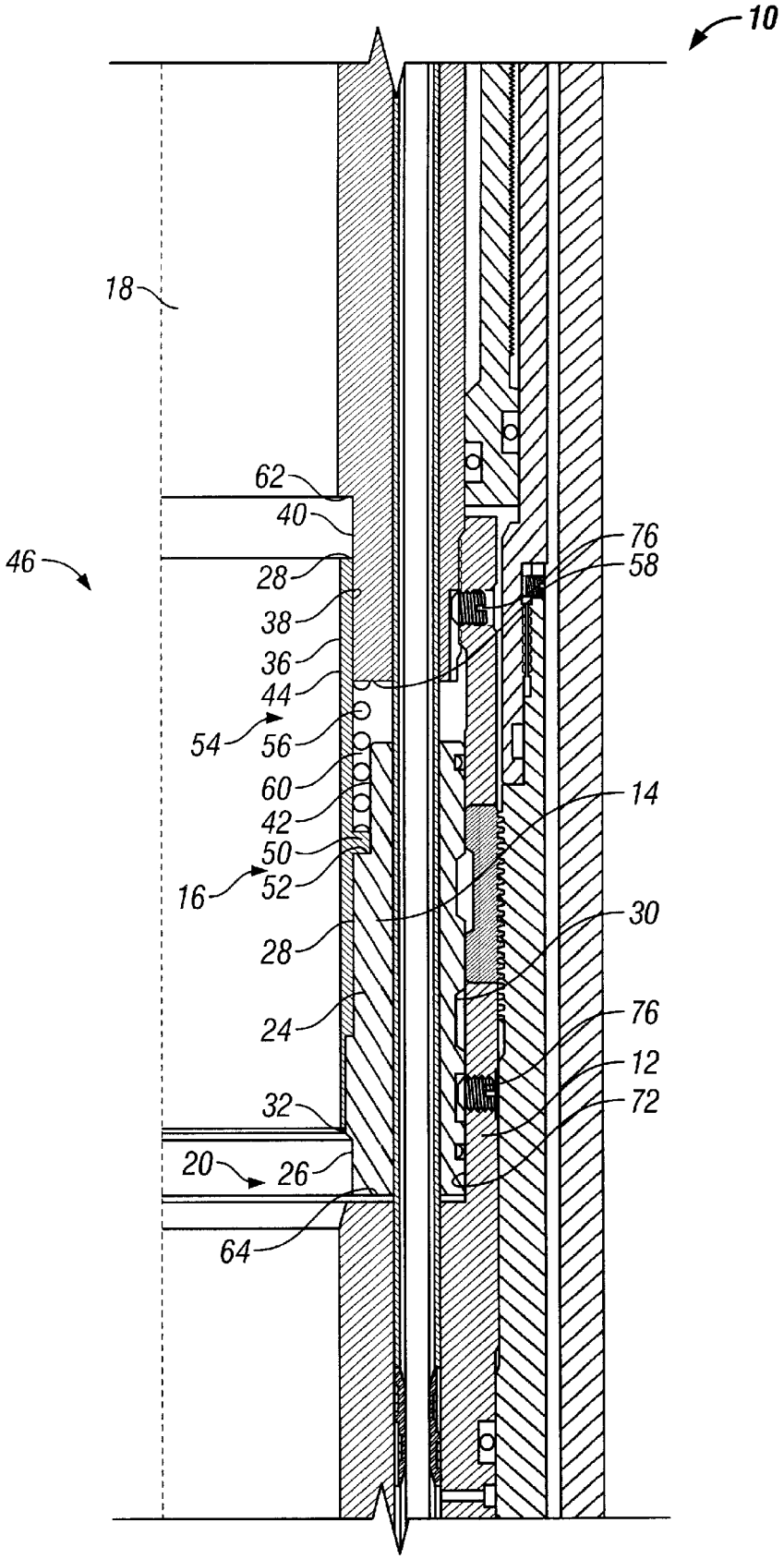
FIG. 1 is a partial longitudinal cross-sectional view of a well tool (packer) that includes the protective member in a first position.
Figure 2:
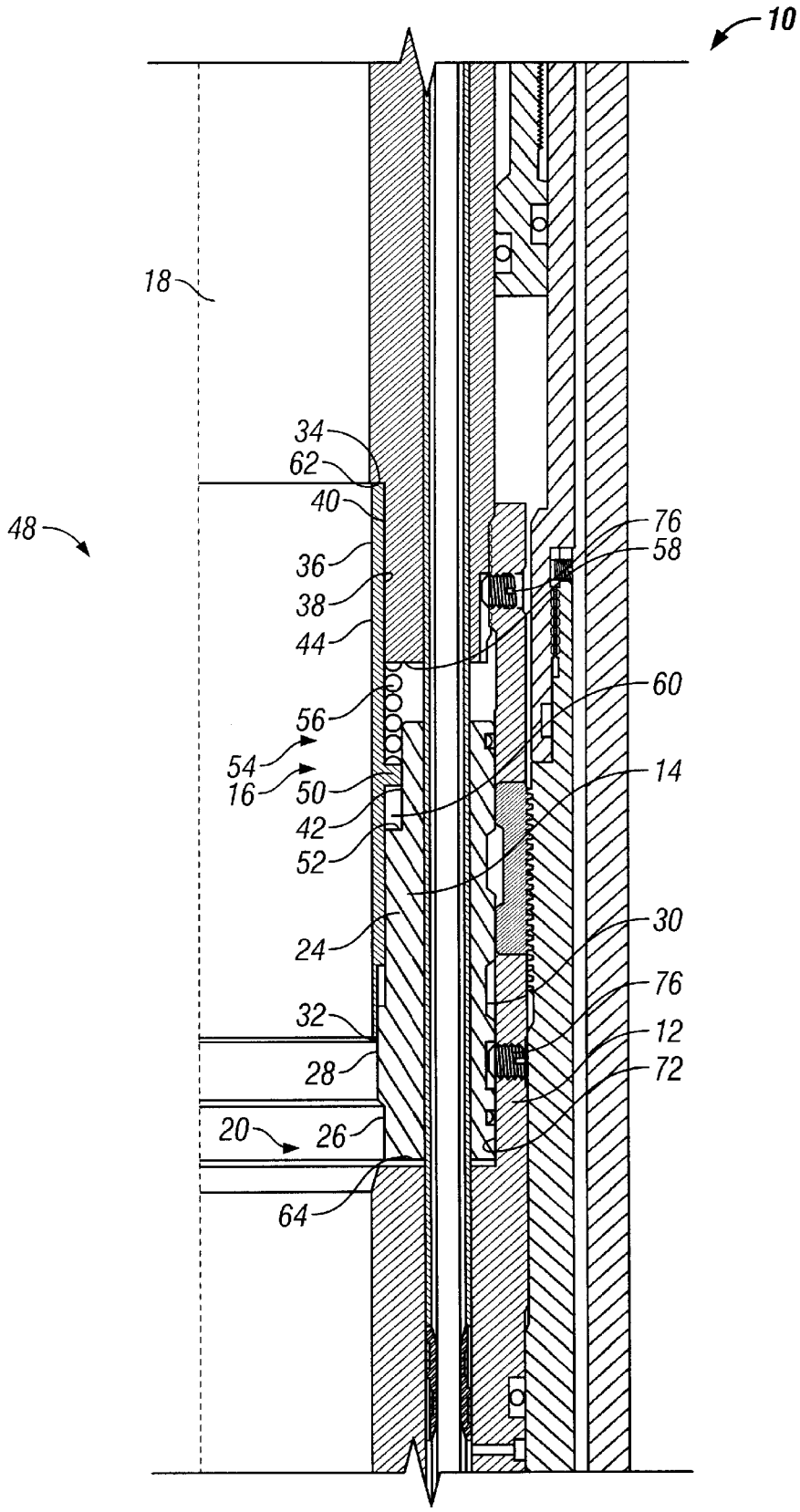
FIG. 2 is a partial longitudinal cross-sectional view of a well tool of FIG. 1 with the protective member in a second position.
Figure 3:
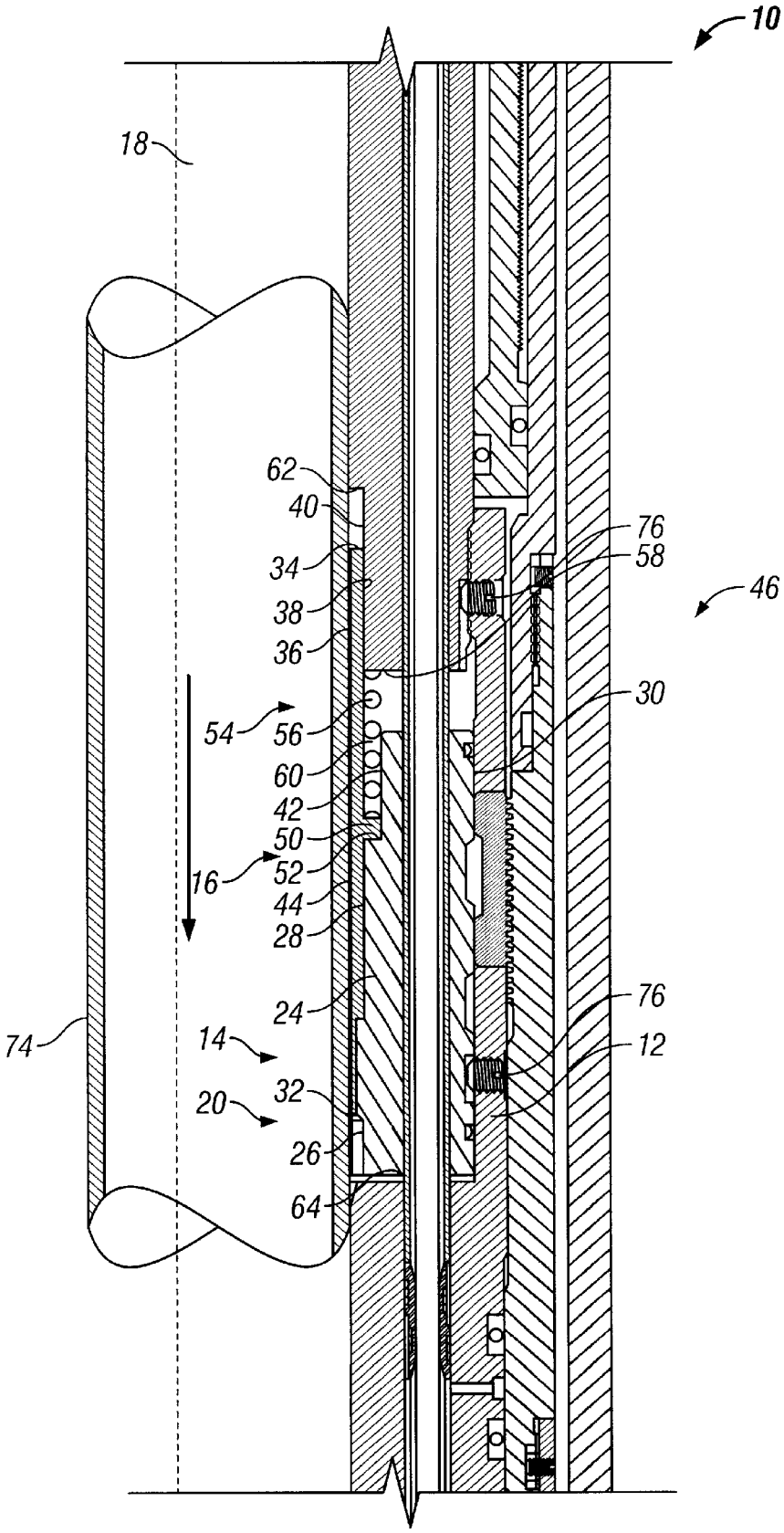
FIG. 3 is a partial longitudinal cross-sectional view of the well tool of FIG. 1 illustrating peripheral equipment passing downwardly through the longitudinal bore of the well tool.
Figure 4:
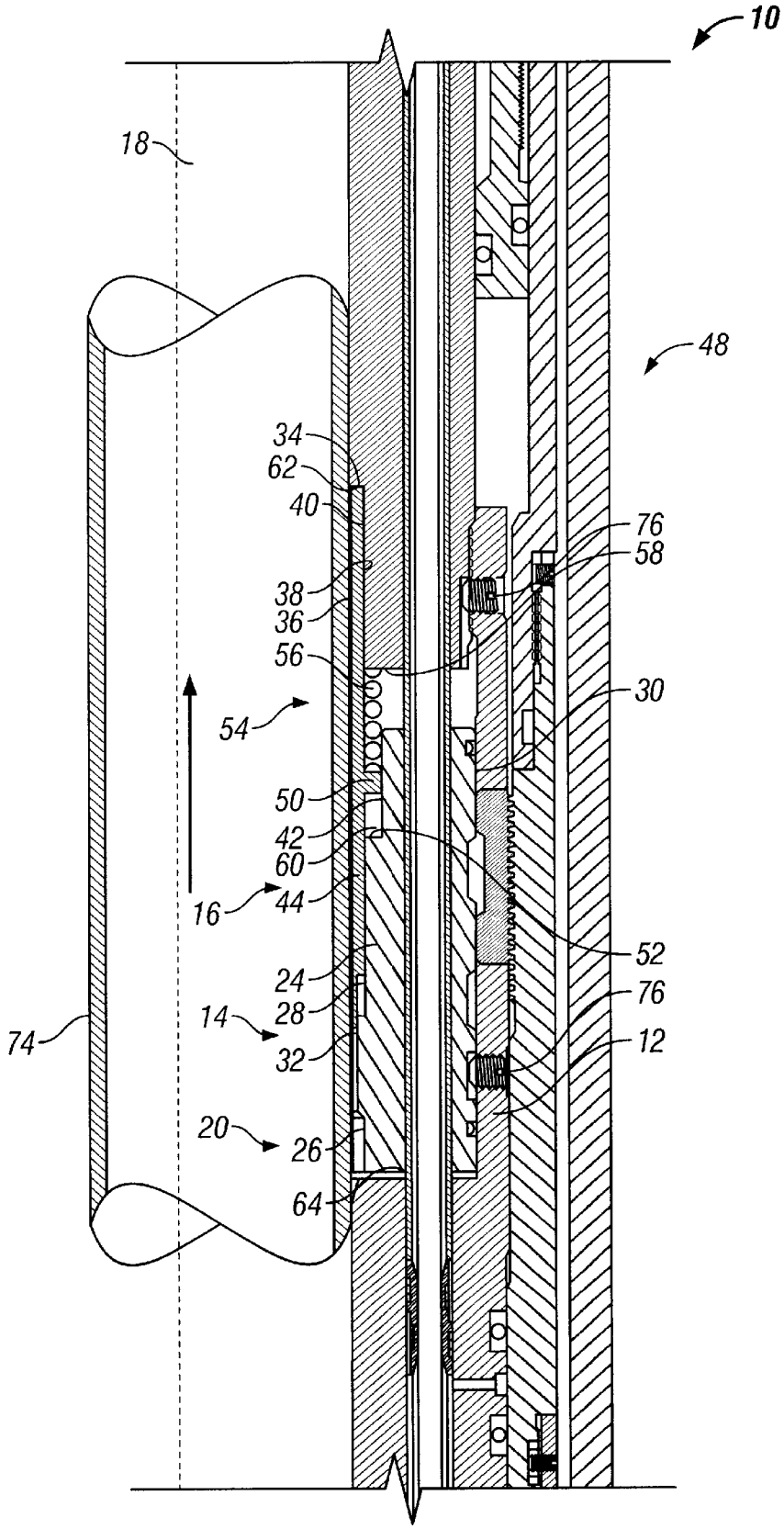
FIG. 4 is a partial longitudinal cross-sectional view of the well tool of FIG. 1 illustrating peripheral equipment passing upwardly through the longitudinal bore of the well tool.
Figure 5:
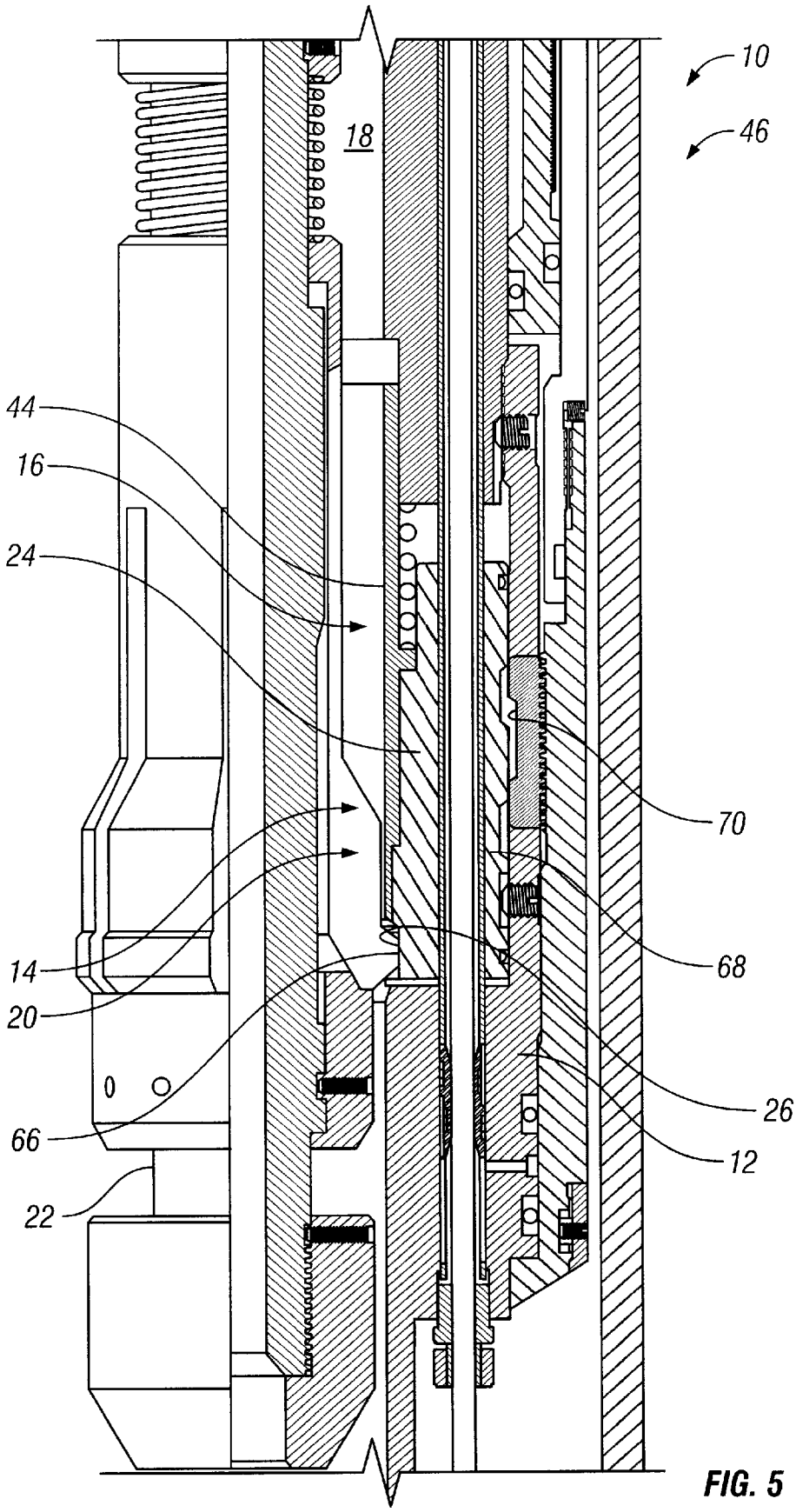
FIG. 5 is a partial longitudinal cross-sectional view of the well tool of FIG. 1 illustrating an activating tool disposed in the longitudinal bore of the well tool.

The invention is generally illustrated as 10 in FIGS. 1–5. The well tool 10 includes a body 12, an actuating mechanism 14, and a protective member 16. As is understood in the art, the well tool 10 is attached to tubing string disposed within a wellbore. Body 12 is generally cylindrical in shape and includes a longitudinal bore 18 defined therethrough. The actuating mechanism 14, which includes an engagement section 20, is adapted to be mechanically activated from within the longitudinal bore 18 by an activating tool 22. The activating tool 22 activates the actuating mechanism 14 by selectively engaging the engagement section 20. The protective member 16 is disposed within the longitudinal bore 18. The protective member 16 is adapted to prevent peripheral equipment 74 being passed through the longitudinal bore 18 from inadvertently activating the actuating mechanism 14 by somehow catching on to the engagement section 20. The protective member 16, however, is adapted to enable the activating tool 22 to selectively engage the engagement section 20 of the actuating mechanism 14.

Although the well tool 10 illustrated in the Figures is a packer, it is understood that this invention may be utilized in any well tool which is mechanically activated from within its longitudinal bore. The aim of the invention, and particularly the protective member 16, is to ensure that the respective well tool 10 is not activated, regardless of the peripheral equipment 74 that is passed through the longitudinal bore 18, until the tool-specific activating tool 22 engages the engagement section 20. Besides packers, this invention may also function in valves, sliding sleeves, mechanical releases, and kickover tools, to name but a few.

In one embodiment, the actuating mechanism 14 is an activation member 24 including an inner surface 28, an outer surface 30, and at least a first end 64. In this embodiment, the engagement section 20 comprises a profile 26 defined on the activation member inner surface 28, and preferably exposed to the longitudinal bore 18. It is understood that the embodiment (shape, movement action, etc.) of the actuating mechanism 14 is dependent on the well tool 10.

The protective member 16 includes a first end 32, a second end 34, an inner surface 36, and an outer surface 38. In the preferred embodiment, the protective member first end 32 is proximate the engagement section 20 or profile 26. Preferably, the protective member 16 substantially covers the actuating mechanism 14 while leaving the engagement section 20 or profile 26 exposed to the longitudinal bore 18. In this embodiment, the protective member inner surface 36 is proximate the longitudinal bore 18, and the protective member outer surface 38 is proximate the actuating mechanism 14. Thus, the actuating mechanism 14 is located intermediate the body 12 and the protective member 16 with the protective member 16 being proximate the longitudinal bore 18. In addition, the protective member inner surfacer 36 is, in the preferred embodiment, concentric with the longitudinal bore 18. This interrelation is enabled, in one embodiment, by the disposition of the actuating mechanism 14 within a body slot 72 defined on the body 12 and the disposition of the protective member 16 within a body recess 40 and an actuating mechanism recess 42.

In the preferred embodiment, the protective member 16 comprises a sleeve 44, including the sleeve first end 32, sleeve second end 34, the sleeve inner surface 36, and the sleeve outer surface 38. The sleeve 44 is also preferably slidably disposed within the longitudinal bore 18. In the preferred embodiment, the sleeve 44 is slidably disposed on the body recess 40 and the actuating mechanism recess 42. In the preferred embodiment, the sleeve 44 is concentric with the longitudinal bore 18, and the cross-sectional diameter of the sleeve inner surface 36 is preferably slightly larger than the cross-sectional diameter of the longitudinal bore 18.

In the preferred embodiment, sleeve 44 includes a sleeve extension 50, preferably defined on the sleeve outer surface 38 and annular in shape. Sleeve extension 50 is disposed within an annular space 60 defined on the activation member outer surface 38.

The sliding movement of sleeve 44 within longitudinal bore 18 defines a sleeve first position 46 and a sleeve second position 48. In the sleeve first position 46, the sleeve first end 32 is proximate the profile 26, and the sleeve extension 50 abuts a second longitudinal bore shoulder 52, preferably defined on the actuating mechanism 14 at one end of the annular space 60. In the preferred embodiment, a biasing mechanism 54 biases the sleeve 44 to the first position 46. Biasing mechanism 54 preferably comprises a spring 56 wedged between the sleeve extension 50 and a first longitudinal bore shoulder 58. The first longitudinal bore 58 is preferably defined on the body 12 so that spring 56 extends at least partially within the annular space 60. In the second position 48, the sleeve 44 has slid away from profile 26 so that sleeve second end 34, which is distal to the profile 26, abuts a third longitudinal bore shoulder 62. Third longitudinal bore shoulder 62 is preferably defined on body 12. When sleeve 44 is in the second position 48, sleeve first end 32 has moved away from profile 26, sleeve extension 50 has moved towards first longitudinal bore 58 and no longer abuts second longitudinal bore 52, and spring 56 is compressed. Sleeve 44 moves from the first position 46 to the second position 48 as a result of an external force applied on the sleeve 44 in the upwards direction, that is towards the third longitudinal bore shoulder 62.

IN OPERATION

As previously disclosed, various types of equipment 74 are passed through the longitudinal bore 18 of a well tool 10 while the well tool 10 is downhole. Without the protective member 16 or sleeve 44, any of such equipment 74 may exert a mechanical force (even if only by friction) on the actuating mechanism 14 as the equipment 74 drags or passes through the longitudinal bore 18 thereby inadvertently activating the actuating mechanism 14. Or, perhaps more flagrantly, without the protective member 16 or sleeve 44, any of such equipment 74 may catch on the engagement section 20 or profile 26 of the actuating mechanism 14 as the equipment 74 drags or passes through the longitudinal bore 18 thereby also inadvertently activating the actuating mechanism 14.

With the protective member 16 or sleeve 44, the inadvertent activation of the actuating mechanism 14 is for the most part prevented until the activating tool 22 is disposed downhole for that purpose. Such inadvertent activation is prevented because the presence of the protective member 16 or sleeve 44 over the actuating mechanism 14 greatly reduces the amount of actuating mechanism surface area that can be acted on by the equipment 74 as it drags or passes through the longitudinal bore 18. Since the protective member 16 or sleeve 44 leaves only the profile 26 exposed to the longitudinal bore 18, then a piece of equipment 74 activates the actuating mechanism 14 only if the equipment 74 catches on the profile 26. However, since the linear length of a piece of downhole equipment 74 is typically much larger than the linear length of the profile 26, the geometry of the configuration makes it highly unlikely for the piece of downhole equipment 74 to catch on the profile 26.

As a piece of equipment 74 is being passed downwardly through the longitudinal bore 18, the piece of equipment 74 may drag on the surface of the longitudinal bore 18. Eventually, the piece of equipment 74 may pass by the sleeve 44 perhaps also dragging on it; however, the abutment of the sleeve extension 50 to the second longitudinal bore shoulder 52 as well as the shear screw 76 connection of the actuating mechanism 14 to the body 12 prevent the sleeve 44 from travelling downwardly. Since the linear length of the piece of equipment 74 is much larger than the linear length of the profile 26, the piece of equipment 74 simply passes the profile 26 without catching on it.

As a piece of equipment 74 is being passed upwardly through the longitudinal bore 18, the piece of equipment 74 may drag on the surface of the longitudinal bore. Since the linear length of the piece of equipment 74 is much larger than the linear length of the profile 26, the piece of equipment 74 simply passes the profile 26 without catching on it. Eventually, the piece of equipment 74 may pass by the sleeve 44 perhaps also dragging on it. If the piece of equipment 74 drags on the sleeve inner surface 36, then the sleeve 44 may move from the first position 46 towards the second position 48. However, since sleeve 44 is slidably disposed on and is not rigidly connected to the actuating mechanism 14, the sleeve 44 travels towards the second position 48 without transferring onto the actuating mechanism 14 the drag force imparted by the piece of equipment 74. Thus, the actuating mechanism 14 is not activated. If the piece of equipment 74 forces the sleeve 44 to the second position 48, once the piece of equipment 74 completely passes the sleeve 44, the spring 56 biases the sleeve 44 back to the first position 46.

It is noted that in the preferred embodiment, since the cross-sectional diameter of the sleeve inner surface 36 is slightly larger than the cross-sectional diameter of the longitudinal bore 18, equipment 74 being passed through the longitudinal bore 18 has less of a chance to drag on sleeve 44.

When the operator desires to activate the actuating mechanism 14, the operator runs the tool-specific activating tool 22 in the tubing string. The activating tool 22 includes the latch 66, well-known in the art, that exactly corresponds to the profile 26 of the actuating mechanism 14. Therefore, the linear lengths of the latch 66 and the profile 26 are identical. Eventually, as the activating tool 22 is run downhole, the latch 66 will find the profile 26 and become lodged therein. The operator may then impart the appropriate motion/force to the activating tool 22. Since the activating tool 22 is now lodged to the actuating mechanism 14, the appropriate movement/force of the activating tool 22 will also force the actuating mechanism 14 to move thereby mechanically activating the actuating mechanism 14. Activation may encompass any of a variety of events, depending on the well tool 10. The activation of the packer illustrated in the Figures may encompass, for instance, either the setting or the releasing of the packer.

In the well tool 10 illustrated, activation of the actuating mechanism 14 is by upward mechanical motion. It is noted that as the actuating mechanism 14 is forced upward by its engagement to the activating tool 22, the actuating mechanism 14 also forces the sleeve 44 upward, due to the abutment of the sleeve extension 50 and second longitudinal bore shoulder 52. The sleeve 44, since it is slidably disposed within the longitudinal bore 18, does not obstruct the movement necessary to activate the actuating mechanism 14, which in the well tool 10 is until the key 68 catches on the key slot 70. Of course, the sleeve 44 should be able to move enough so that it does not obstruct the activating movement of the actuating mechanism 14.

The operation of the invention further enables a new and novel method for preventing equipment 74 being passed through the longitudinal bore 18 of the well tool 10 from inadvertently mechanically activating the actuating mechanism 14 of the well tool 10. The method generally comprises the steps of substantially covering the actuating mechanism 14 with a protective member 16; and ensuring that the linear length of the engagement section 20 is relatively smaller than the linear length of the equipment 74. The method may further comprise the step of leaving the engagement section 20 of the actuating mechanism 14 exposed to the longitudinal bore 18. In addition, the method may comprise the step of slidably disposing the protective member 16 within the longitudinal bore 18. The method may also comprise the step of concentrically aligning the protective member 16 with the longitudinal bore 18, with the cross-sectional diameter of the protective member inner surface 36 being slightly larger than the cross-sectional diameter of the longitudinal bore 18.

It is to be understood that the invention is not limited to the exact details of construction, operation, exact materials or embodiments shown and described, as obvious modifications and equivalents will be apparent to-one skilled in the art. Accordingly, the invention is therefore to be limited only by the scope of the appended claims.

What is claimed is:

1. A well tool, comprising:

a body having a longitudinal bore;

an actuating mechanism including an engagement section;

the actuating mechanism adapted to be mechanically activated from within the longitudinal bore by the selective engagement of an activating tool to the engagement section of the actuating mechanism;

a protective member disposed within the longitudinal bore and adapted to slide with respect to the actuating mechanism to prevent equipment being passed through the longitudinal bore from inadvertently activating the actuating mechanism, the protective member, while in a first position, being adapted to substantially cover the actuating mechanism while leaving the engagement section exposed to the longitudinal bore; and the protective member adapted to enable the activating tool to selectively engage the engagement section of the actuating mechanism.

2. A tool as in claim 1, wherein the engagement section is a profile defined on the actuating mechanism.

3. A tool as in claim 2, wherein the profile is exposed to the longitudinal bore.

4. A tool as in claim 1, wherein the protective member includes a first end proximate the engagement section.

5. A tool as in claim 1, wherein:

the actuating mechanism is intermediate the body and the protective member; and the engagement section is exposed to the longitudinal bore.

6. A tool as in claim 1, wherein the protective member is concentric to the longitudinal bore.

7. The well tool of claim 1, wherein the tool comprises a packer.

8. The well tool of claim 7, wherein the engagement section of the actuating mechanism is engaged to set the packer.

9. The well tool of claim 7, wherein the engagement section of the actuating mechanism is engaged to release the packer.

10. The well tool of claim 1, wherein the protective member is adapted to slide to a second position to cover the engagement section in response to a frictional force exerted on the protective member by the equipment.

11. A well tool, comprising:

a body having a longitudinal bore;

an actuating mechanism having a profile defined thereon;

the actuating mechanism adapted to be mechanically activated from within the longitudinal bore by the selective engagement of an activating tool to the profile of the actuating mechanism;

a sleeve adapted to slide with respect to the actuating mechanism to prevent equipment being passed through the longitudinal bore from inadvertently activating the actuating mechanism and being disposed within the longitudinal bore, the sleeve, while in a first position, being adapted to substantially cover the actuating-mechanism while leaving the profile exposed to the longitudinal bore; and the sleeve adapted to enable the activating tool to selectively engage the profile of the actuating mechanism.

12. A tool as in claim 11, wherein the profile is exposed to the longitudinal bore.

13. A tool as in claim 11, wherein:

the actuating mechanism is intermediate the body and the sleeve; and the profile is exposed to the longitudinal bore.

14. A tool as in claim 11, wherein the sleeve is concentric to the longitudinal bore.

15. A tool as in claim 11, wherein:

the sleeve includes a first end; and the sleeve has a first position in which the sleeve first end is proximate the profile.

16. A tool as in claim 15, further comprising a biasing mechanism biasing the sleeve to the first position.

17. A tool as in claim 16, wherein:

the biasing mechanism comprises a spring; and the spring is disposed between a first longitudinal bore shoulder and a sleeve extension.

18. A tool as in claim 17, wherein the sleeve extension abuts a second longitudinal bore shoulder when the sleeve is in the first position.

19. A tool as in claim 18, wherein:

the sleeve includes a second end distal the profile; and the sleeve has a section position in which the sleeve section end abuts a third longitudinal bore shoulder.

20. A tool as in claim 15, wherein:

the sleeve includes an inner surface;

the sleeve is concentric with the longitudinal bore; and the cross-sectional diameter of the sleeve inner surface is slightly larger than the cross-sectional diameter of the longitudinal bore.

21. The well tool of claim 11, wherein the sleeve is adapted to slide to a second position to cover the actuating mechanism in response to a frictional force exerted on the protective member by the equipment.

22. A method comprising:

providing a protective member that is slidable with respect to the actuating mechanism to prevent equipment being passed through a longitudinal bore of a well tool from inadvertently mechanically activating an actuating mechanism of the well tool;

substantially covering the actuating mechanism with the protective member while leaving an engagement section of the actuating mechanism exposed to the longitudinal bore; and ensuring that the linear length of the engagement section of the actuating mechanism is relatively smaller than the linear length of the equipment.

23. The method of claim 22, further comprising slidably disposing the protective member within the longitudinal bore.

24. The method of claim 22, further comprising concentrically aligning the protective member with the longitudinal bore, with the cross-sectional diameter of the protective member inner surface being slightly larger than the cross-sectional diameter of the longitudinal bore.

25. The method of claim 22, further comprising:

sliding the protective member to cover the engagement section in response to a frictional force exerted on the protective member by the equipment.

26. A well tool usable with a subterranean well comprising:

a main body having a passageway;

an actuating mechanism having an engagement profile and adapted to respond to an activating tool engaging the engagement profile from within the passageway; and a protective member to slide with respect to the actuating mechanism, to the member substantially covering the actuating mechanism while in a first position, leaving the engagement profile exposed to the passageway.

27. The well tool of claim 26, wherein the passageway comprises a longitudinal bore of the tool.

28. The well tool of claim 26, wherein the tool comprises a packer.

29. The well tool of claims 28, wherein the profile of the actuating mechanism is engaged to set the packer.

30. The well tool of claim 28, wherein the profile of the actuating mechanism is engaged to release the packer.

* * * * *